US009957928B2

(12) United States Patent
Watanabe et al.

(10) Patent No.: US 9,957,928 B2
(45) Date of Patent: May 1, 2018

(54) SUPERCHARGING SYSTEM FOR ENGINE

(71) Applicant: Kawasaki Jukogyo Kabushiki Kaisha, Hyogo (JP)

(72) Inventors: Hiroyuki Watanabe, Kobe (JP); Hisatoyo Arima, Himeji (JP); Satoaki Ichi, Akashi (JP); Yoshinobu Tanaka, Hyogo (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 185 days.

(21) Appl. No.: 14/740,160

(22) Filed: Jun. 15, 2015

(65) Prior Publication Data

US 2015/0275830 A1 Oct. 1, 2015

Related U.S. Application Data

(63) Continuation of application No. PCT/JP2013/080513, filed on Nov. 12, 2013.

(30) Foreign Application Priority Data

Dec. 17, 2012 (JP) ..... 2012-274478

(51) Int. Cl.
*F02M 35/10* (2006.01)
*F02M 35/16* (2006.01)
(Continued)

(52) U.S. Cl.
CPC ..... *F02M 35/162* (2013.01); *F01M 13/00* (2013.01); *F01M 13/0033* (2013.01);
(Continued)

(58) Field of Classification Search
CPC .. F02M 35/162; F02M 35/0204; F02M 35/04; F02M 35/10157; F02M 35/10209;
(Continued)

(56) References Cited

U.S. PATENT DOCUMENTS 3,143,849 A * 8/1964 Glamann ..... F02B 37/04 60/599
3,568,435 A * 3/1971 May ..... F02B 37/16 123/559.1
(Continued)

FOREIGN PATENT DOCUMENTS

CN 101506488 8/2009
CN 101892994 11/2010
(Continued)

OTHER PUBLICATIONS

Machine Translation of JP 02024282, Translated on Sep. 1, 2017.*
(Continued)

*Primary Examiner* — Patrick Maines

(57) ABSTRACT

A supercharging system for a combustion engine of a motorcycle includes a supercharger which pressurizes intake air and supplies the intake air to the combustion engine, an air intake chamber which is connected to downstream of the supercharger, a relief passage which relieves the high-pressure intake air within the air intake chamber, and a relief valve which is provided on the relief passage. The air intake chamber is disposed above the combustion engine, and the relief passage is disposed below an upper end of the air intake chamber. The relief passage is connected to a front surface of the air intake chamber.

18 Claims, 4 Drawing Sheets

(51) Int. Cl.

| | |
|---|---|
| ***F02B 39/00*** | (2006.01) |
| ***F02B 39/04*** | (2006.01) |
| ***F01M 13/00*** | (2006.01) |
| ***F01M 13/04*** | (2006.01) |
| ***F02F 7/00*** | (2006.01) |
| ***F02B 33/40*** | (2006.01) |
| ***F04D 17/10*** | (2006.01) |
| ***F02B 33/44*** | (2006.01) |
| *F02M 35/02* | (2006.01) |
| *F02M 35/04* | (2006.01) |
| *F01M 13/02* | (2006.01) |

(52) U.S. Cl.

CPC ..... *F01M 13/022* (2013.01); *F01M 13/04* (2013.01); *F02B 33/40* (2013.01); *F02B 33/44* (2013.01); *F02B 39/00* (2013.01); *F02B 39/04* (2013.01); *F02F 7/00* (2013.01); *F04D 17/10* (2013.01); *F01M 2013/0038* (2013.01); *F01M 2013/027* (2013.01); *F01M 2013/0477* (2013.01); *F02M 35/0204* (2013.01); *F02M 35/04* (2013.01); *F02M 35/10157* (2013.01); *F02M 35/10209* (2013.01); *F02M 35/10255* (2013.01); *F02M 35/16* (2013.01)

(58) Field of Classification Search

CPC .. F02M 35/10255; F02M 35/16; F01M 13/00; F01M 13/0033; F01M 13/04; F01M 2013/0038; F01M 2013/027; F01M 2013/0477; F02B 33/40; F02B 33/44; F02B 39/00; F02B 39/04; F02F 7/00; F04D 17/10

USPC ..... 60/611; 123/559.1

See application file for complete search history.

(56) References Cited

U.S. PATENT DOCUMENTS

| | | | | |
|---|---|---|---|---|
| 4,513,725 | A | 4/1985 | Minami et al. | |
| 4,735,178 | A | 4/1988 | Inoue et al. | |
| 4,760,703 | A * | 8/1988 | Minami | F02B 33/44 123/184.42 |
| 4,799,466 | A * | 1/1989 | Shibata | F02D 41/0005 123/327 |
| 5,140,816 | A * | 8/1992 | Scicluna | F02B 33/44 123/559.1 |
| 8,646,438 | B2 | 2/2014 | Saeki et al. | |
| 8,707,931 | B2 * | 4/2014 | Arima | F02B 33/32 123/478 |
| 9,303,603 | B2 * | 4/2016 | Naruoka | F02M 35/14 |
| 2010/0175946 | A1 | 7/2010 | Karube et al. | |
| 2012/0192839 | A1 | 8/2012 | Arima et al. | |
| 2012/0260896 | A1 | 10/2012 | Saeki et al. | |
| 2016/0061162 | A1 * | 3/2016 | Watanabe | B62K 19/48 123/559.1 |
| 2017/0114709 | A1 * | 4/2017 | Okita | F02B 29/0406 |
| 2017/0226971 | A1 * | 8/2017 | Yamamoto | F02M 35/10163 |

FOREIGN PATENT DOCUMENTS

| | | | | |
|---|---|---|---|---|
| CN | 102242735 | | 11/2011 | |
| DE | 102007055617 | | 5/2009 | |
| GB | 264686 | | 1/1927 | |
| JP | 57-073820 | | 5/1982 | |
| JP | 59-103825 | | 7/1984 | |
| JP | 01-232112 | | 9/1989 | |
| JP | 02-006289 | | 1/1990 | |
| JP | 02-024282 | | 1/1990 | |
| JP | 02-024283 | | 1/1990 | |
| JP | 02024282 | A * | 1/1990 | |
| JP | 02024283 | A * | 1/1990 | F02B 61/02 |
| JP | 05-040092 | | 5/1993 | |
| JP | 08-312361 | | 11/1996 | |
| JP | 10-047069 | | 2/1998 | |
| JP | 2003-127965 | | 5/2003 | |
| JP | 2011-230649 | | 11/2011 | |
| WO | 2011/046098 | | 4/2011 | |
| WO | 2011/080974 | | 7/2011 | |

OTHER PUBLICATIONS

Translation of JP 02024282 A, Translated Nov. 2017.*

First Office Action dated Oct. 25, 2016 for Corresponding Chinese Patent Application No. 201380065500.7 and English Language Translation of the Search Report Attached to the Office Action (7 pages).

PCT/JP2013/080513 International Search Report dated Jan. 21, 2014, 2 pages.

PCT Application No. PCT/JP2013/0080513 International Preliminary Report on Patentability dated Jun. 23, 2015, 8 pages.

Notification of Reason(s) for Rejection dated Mar. 28, 2017 with English language Summary for Corresponding Japanese Patent Application No. 2014-553017 (5 pages).

Extended and Supplementary Search Report dated Jan. 9, 2017 for Corresponding European Patent Application No. 13865742.4 (7 pages).

Communication Pursuant to Article 94(3) EPC dated Aug. 30, 2017 for Corresponding European Patent Application No. 13865742.4 (4 pages).

* cited by examiner

SUPERCHARGING SYSTEM FOR ENGINE

CROSS REFERENCE TO THE RELATED APPLICATION

This application is a continuation application, under 35 U.S.C. § 111(a) of international application No. PCT/JP2013/080513, filed Nov. 12, 2013, which claims priority to Japanese patent application No. 2012-274478, filed Dec. 17, 2012, the entire disclosure of which is herein incorporated by reference as a part of this application.

BACKGROUND OF THE INVENTION

Field of the Invention

The present invention relates to a supercharging system as used in a combustion engine of a saddle-riding type vehicle such as a motorcycle, in which a supercharger pressurizes air and supplies the air to the combustion engine, and an air intake chamber is connected to downstream of the supercharger.

Description of Related Art

As a combustion engine of a saddle-riding type vehicle such as a motorcycle, there has been known such a combustion engine that a supercharger pressurizes air and supplies the air to the combustion engine body and an air intake chamber stores the intake air pressurized by the supercharger. In such a combustion engine, a relief passage and a relief valve are generally provided in order to suppress an increase in the pressure within the air intake chamber (e.g., Patent Document 1).

RELATED DOCUMENT

Patent Document

[Patent Document 1] WO2011/046098

However, in the combustion engine described in Patent Document 1, the relief valve is disposed above the air intake chamber, and thus a device disposed above the combustion engine, such as a fuel tank, interferes with the relief passage and the relief valve.

SUMMARY OF THE INVENTION

In view of the above problem, an object of the present invention is to provide a supercharging system for a combustion engine, which is able to prevent a relief passage and a relief valve from interfering with a component above the combustion engine.

In order to achieve the above-described object, a supercharging system for a combustion engine according to the present invention includes a supercharger configured to pressurize intake air and supply the intake air to a combustion engine of a saddle-riding type vehicle, an air intake chamber connected to downstream of the supercharger, a relief passage configured to relieve high-pressure gas within the air intake chamber; and a relief valve provided on the relief passage. The air intake chamber is disposed above the combustion engine, and the relief passage is disposed below an upper end of the air intake chamber and connected to an outer surface of the air intake chamber other than an upper surface of the air intake chamber.

According to this configuration, since the relief passage is disposed below the upper end of the air intake chamber and connected to the outer surface of the air intake chamber other than the upper surface of the air intake chamber, the relief passage including the relief valve does not interfere with a component above the combustion engine.

In the present invention, the relief valve is preferably disposed on the relief passage and at a position distant from the air intake chamber. According to this configuration, the volume in which pressurized intake air can be stored, is increased by the volume of a passage between the relief valve and the air intake chamber, in the relief passage. In addition, since the relief valve is disposed away from the air intake chamber, the degree of freedom in disposing the relief valve increases.

In the present invention, the relief passage is preferably connected to an outer surface of the air intake chamber other than the upper surface and side surfaces of the air intake chamber. According to this configuration, since the relief passage is connected to a front surface, a rear surface, or a lower surface of the air intake chamber, it is possible to reduce the dimension of the vehicle in a widthwise direction of the vehicle.

In the present invention, preferably, the supercharger is disposed rearward of a cylinder block of the combustion engine, the air intake chamber is located above the supercharger, and the relief passage is connected to a front surface of the air intake chamber. According to this configuration, the relief passage including the relief valve does not interfere the supercharger disposed below the relief passage, and it is possible to effectively utilize a space around the combustion engine.

In the present invention, preferably, a center, in a widthwise direction of the vehicle, of the air intake chamber is displaced to one side in the widthwise direction of the vehicle with respect to a center, in the widthwise direction of the vehicle, of the combustion engine, and the relief passage extends through a lateral side of the air intake chamber which is the other side in the widthwise direction of the vehicle. According to this configuration, since the relief passage extends through the lateral side of the air intake chamber disposed so as to be displaced to the one side in the widthwise direction of the vehicle, it is possible to effectively utilize the space around the combustion engine.

In the present invention, preferably, cables of the vehicle are disposed at one lateral side of the air intake chamber, and the relief passage is disposed at the other lateral side of the air intake chamber. Here, the "cables" include electric wires and hydraulic hoses. According to this configuration, it is possible to prevent interference between the cables and the relief passage, and to effectively utilize the space around the combustion engine.

In the present invention, preferably, the supercharger is disposed rearward of a cylinder block of the combustion engine, and an air intake duct configured to supply air in front of the combustion engine to the supercharger extends through a lateral side of the combustion engine. According to this configuration, as compared to the case where an air intake duct extends above the combustion engine, allowance is provided to a space above the combustion engine, and thus the degree of freedom in design increases in a region above the combustion engine.

In the present invention, a downstream end of the relief passage is preferably connected to an air intake passage at an inlet side of the supercharger. According to this configuration, relieved air is smoothly sucked into the air intake passage at the inlet side of the supercharger in which the pressure is low, and is prevented from flowing out of the air intake passage.

In the case where the relief valve is disposed on the relief passage and at a position away from the air intake chamber, the relief passage is preferably connected to a vicinity of an outlet of the air intake chamber. In the case where the relief passage is connected to the vicinity of the outlet of the air intake chamber, there is the possibility that the pressure around the outlet of the air intake chamber decreases. However, according to this configuration, since the relief valve is separated from the air intake chamber as described above, a large amount of pressurized intake air is present between the relief valve and the air intake chamber, and thus it is possible to prevent the pressure around the outlet of the air intake chamber from decreasing.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

A preferred embodiment of the present invention will now be described with reference to the accompanying drawings. The terms "left side" and "right side" in this specification are the left side and the right side as seen from a driver on a vehicle.

Figure 1:
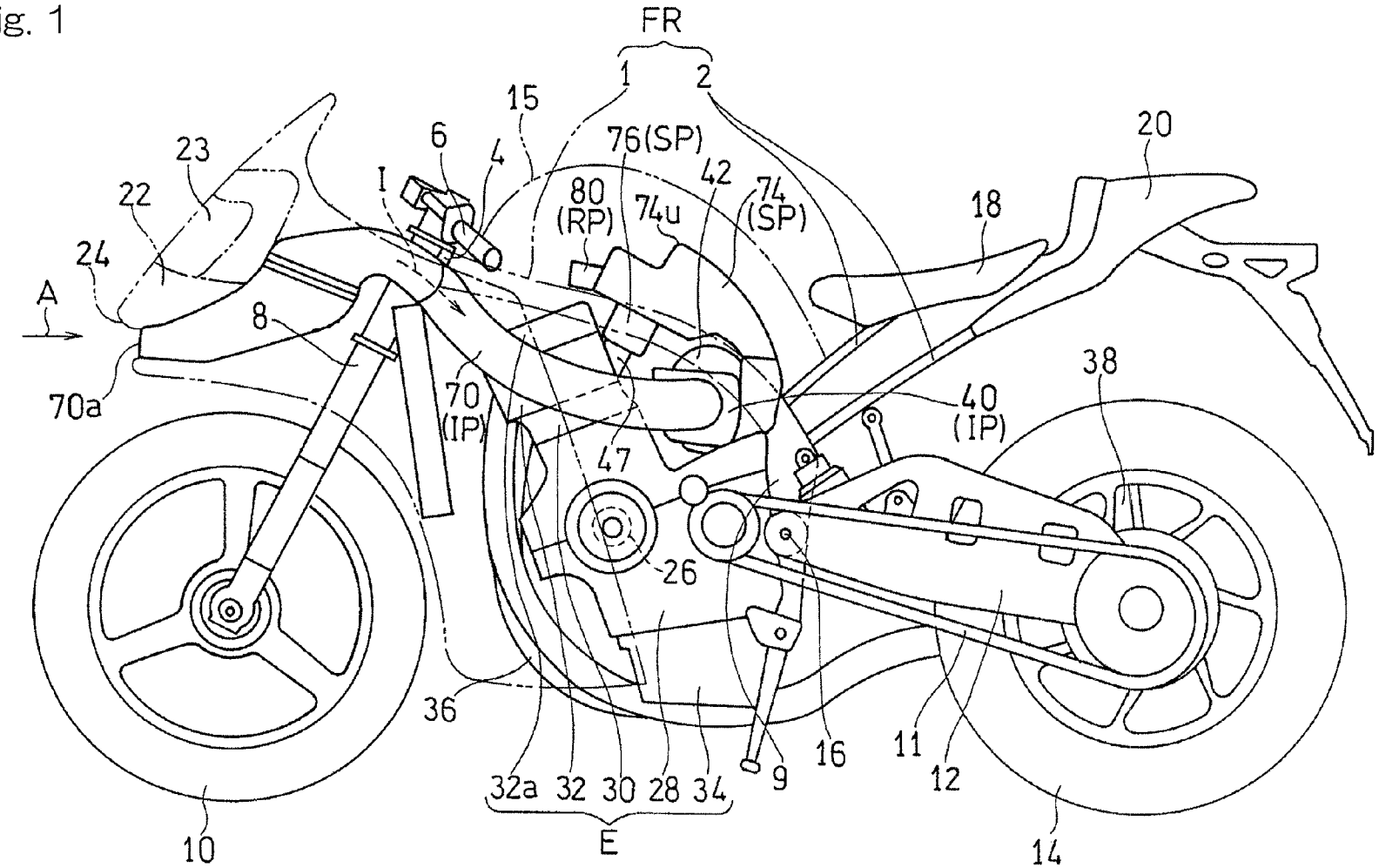
FIG. 1 is a side view of a motorcycle, which is one type of a saddle-riding type vehicle, including a supercharging system for a combustion engine according to a first preferred embodiment of the present invention.

FIG. 1 is a left side view of a motorcycle, which is one type of a saddle-riding type vehicle, including a supercharging system for a combustion engine according to a first preferred embodiment of the present invention. A motorcycle frame structure FR for the motorcycle includes a main frame 1 which forms a front half of the motorcycle frame structure FR, and a seat rail 2 which forms a rear half of the motorcycle frame structure FR. The seat rail 2 is mounted on a rear portion of the main frame 1. A head pipe 4 is integrally formed at a front end of the main frame 1, and a front fork 8 is rotatably supported by the head pipe 4 through a steering shaft (not shown). A front wheel 10 is fitted to a lower end portion of the front fork 8, and a steering handle 6 is fixed to an upper end portion of the front fork 8.

Meanwhile, a swingarm bracket 9 is provided at a rear end portion of the main frame 1, which portion is a lower intermediate portion of the motorcycle frame structure FR. A swingarm 12 is supported for swing movement in an up-down direction about a pivot shaft 16 which is provided at the swingarm bracket 9. A rear wheel 14 is rotatably supported by a rear end portion of the swingarm 12. A combustion engine E which is a drive source is fitted to the lower intermediate portion of the motorcycle frame structure FR at the front side of the swingarm bracket 9. The combustion engine E drives the rear wheel 14 through a power transmission mechanism 11 such as a chain. The combustion engine E is, for example, a parallel multi-cylinder water-cooled combustion engine having four cylinders with four cycles. However, the type of the combustion engine E is not limited thereto.

A fuel tank 15 is disposed on an upper portion of the main frame 1, and a rider's seat 18 and a passenger's seat 20 are supported by the seat rail 2. In addition, a fairing 22 made of a resinous material is mounted on a front portion of the motorcycle body. The fairing 22 covers a portion from front of the head pipe 4 to lateral sides of the front portion of the motorcycle body. A headlamp unit 23 is mounted on the fairing 22. Furthermore, an air inlet 24 is formed in the fairing 22. The air inlet 24 is located below the headlamp unit 23 and takes in intake air from the outside to the combustion engine E.

The combustion engine E includes a crankshaft 26 which extends in a right-left direction (a widthwise direction of the motorcycle), a crankcase 28 which supports the crankshaft 26, a cylinder block 30 which projects upward from an upper surface of a front portion of the crankcase 28, a cylinder head 32 above the cylinder block 30, a cylinder head cover **32*a* which covers an upper portion of the cylinder head 32, and an oil pan 34 which is provided below the crankcase 28. The cylinder block 30 and the cylinder head 32 are slightly inclined frontward. A rear portion of the crankcase 28 also serves as a transmission case. Four exhaust pipes 36 are connected to exhaust ports in a front surface of the cylinder head 32. The four exhaust pipes 36 are merged together at a location beneath the combustion engine E, and are connected to an exhaust muffler 38 which is disposed at the right side of the rear wheel 14**.

A supercharger 42 and an air cleaner 40, which cleans outside air, are disposed rearward of the cylinder block 30 and on an upper surface of the crankcase 28 (transmission case) so as to be aligned in the widthwise direction of the motorcycle. The supercharger 42 pressurizes cleaned air from the air cleaner 40 and supplies it to the combustion engine E.

Figure 2:
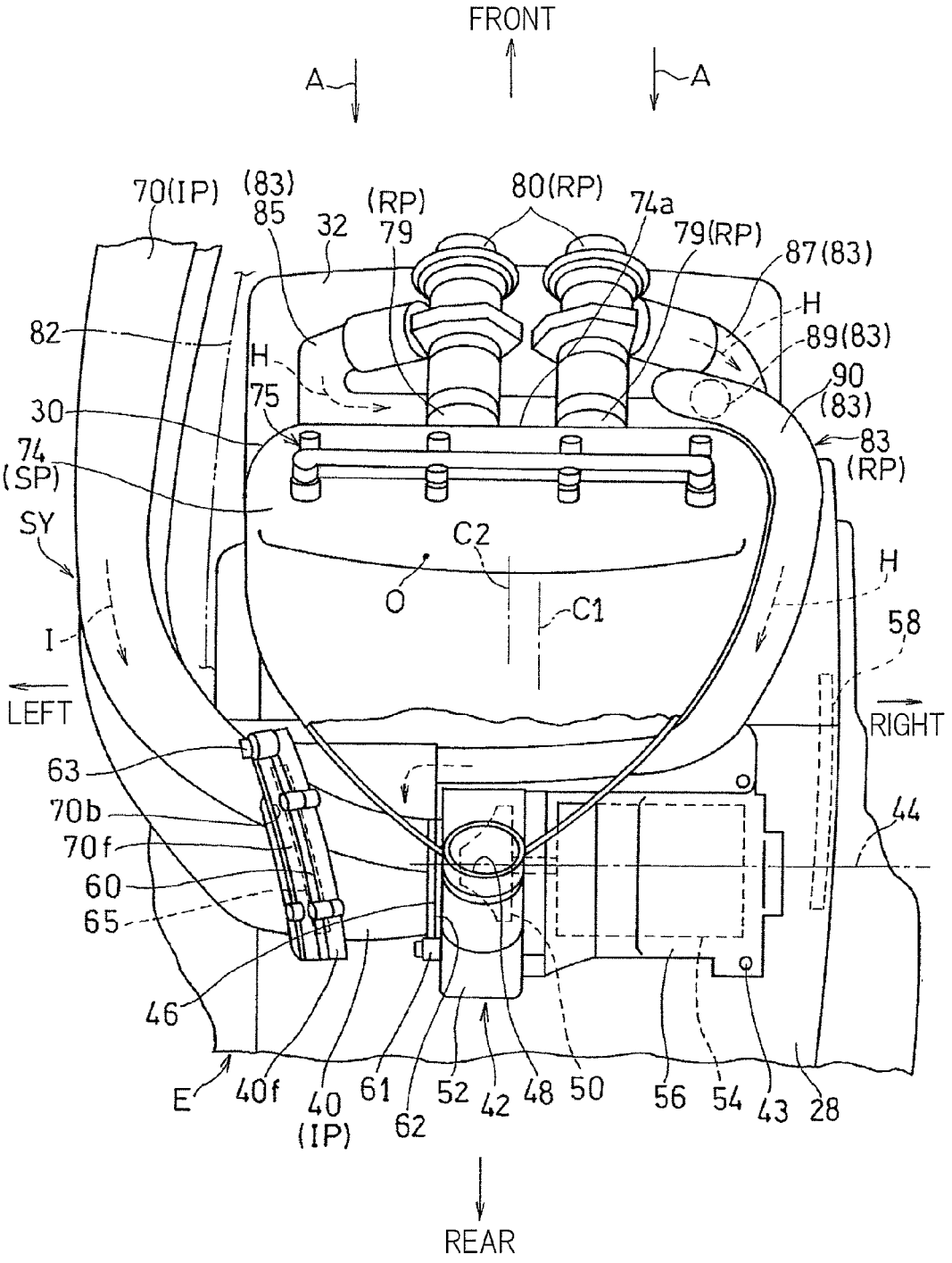
FIG. 2 is a perspective view of the combustion engine of the motorcycle as seen from the rear and obliquely above.

As shown in FIG. 2, the supercharger 42 is disposed adjacently to and at the right side of the air cleaner 40, and fixed to the upper surface of the crankcase 28 by means of a bolt 43. The supercharger 42 has a rotation axis 44 extending in the widthwise direction of the motorcycle. The supercharger 42 includes a suction port 46, located above the crankcase 28 and slightly leftward of a center portion of the combustion engine E in the widthwise direction, and a discharge port 48 located in the center portion of the combustion engine E in the widthwise direction of the motorcycle. The suction port 46 is opened leftward, and the discharge port 48 is opened upward.

The supercharger 42 includes an impeller 50 which pressurizes intake air, an impeller housing 52 which covers the impeller 50, a transmission mechanism 54 which transmits power of the combustion engine E to the impeller 50, and a transmission mechanism housing 56 which covers the transmission mechanism 54. The transmission mechanism 54 and the air cleaner 40 are aligned in the widthwise direction of the motorcycle with the impeller housing 52 located therebetween. The transmission mechanism 54 is disposed so as to be displaced from a center C1, in the widthwise direction of the motorcycle, of the combustion engine E to one side in the widthwise direction of the motorcycle. In this preferred embodiment, the transmission mechanism 54 is disposed so as to be displaced to the right side at which a cam chain 58 is disposed. The cam chain 58 is a drive mechanism for the supercharger 42.

As shown in FIG. 1, an air intake duct 70 is disposed at the left side of the motorcycle frame structure FR and extends below an upper end of the cylinder head 32 and through a lateral region of the cylinder block 30. The air intake duct 70 is supported by the head pipe 4 such that a front end opening 70*a* thereof faces the air inlet 24 of the fairing 22. The pressure of air introduced through the front end opening 70*a* of the air intake duct 70 is increased by a ram effect.

A cleaner outlet 62 of the air cleaner 40 shown in FIG. 2 is connected to the suction port 46 of the supercharger 42 by means of a bolt 61. A rear end portion 70*b* of the air intake duct 70 is connected to a cleaner inlet 60 of the air cleaner 40 by means of a bolt 63 from the outer side in the widthwise direction of the motorcycle. A cleaner element 65 which cleans outside air (intake air) I is disposed between a flange portion 70*f* of the air intake duct 70 and a flange portion 40*f* of the air cleaner 40.

The air intake duct 70 introduces incoming wind A as the intake air I from front of the combustion engine E into the air cleaner 40, passing through the outer left sides of the cylinder block 30 and the cylinder head 32. That is, the air intake duct 70 and the air cleaner 40 cooperate together to form an air intake passage IP which introduces outside air into the supercharger 42.

The air cleaner 40 is disposed rearward of the cylinder head 32 and above the upper surface of the crankcase 28. In addition, the air cleaner 40 is disposed inward of both ends, in the widthwise direction of the motorcycle, of the crankcase 28. The air cleaner 40 is fixed to the crankcase 28 through the supercharger 42. However, the air cleaner 40 may be fixed directly to a combustion engine case.

As shown in FIG. 1, an air intake chamber 74 is disposed between the discharge port 48 of the supercharger 42 and air intake ports 47 of the combustion engine E, and the discharge port 48 of the supercharger 42 and the air intake chamber 74 are directly connected to each other. The air intake chamber 74 stores high-pressure intake air supplied from the discharge port 48 of the supercharger 42. The discharge port 48 of the supercharger 42 and the air intake chamber 74 may be connected to each other via a pipe. The air intake chamber 74 is disposed such that a center C2, in the widthwise direction of the motorcycle, of the air intake chamber 74 is displaced to one side (the left side) in the widthwise direction of the motorcycle with respect to the center C1, in the widthwise direction of the motorcycle, of the combustion engine. The center C2, in the widthwise direction of the motorcycle, of the air intake chamber 74 substantially coincides with the center of a straight line connecting axes of cylinders at both ends in the widthwise direction of the motorcycle. The discharge port 48 is also disposed at substantially the same position in the widthwise direction of the motorcycle as the center C2, in the widthwise direction of the motorcycle, of the air intake chamber 74. Cables 82 of the motorcycle are disposed at the left side of the air intake chamber 74. Here, the "cables" include electric wires and hydraulic hoses.

Throttle bodies 76 are disposed between the air intake chamber 74 and the cylinder head 32. The throttle bodies 76 are provided for cylinders, respectively. In each throttle body 76, fuel is injected from a fuel injection valve 75 (FIG. 2) into intake air so as to generate a fuel-air mixture, and the fuel-air mixture is supplied through the air intake port 47 to a combustion chamber (not shown) within a cylinder bore of the combustion engine E. Each throttle body 76 is disposed so as to be inclined upward from the air intake port 47 towards the rear.

The air intake chamber 74 is disposed above the supercharger 42 and the throttle bodies 76 and rearward of the cylinder head 32. The air cleaner 40 is disposed below the throttle bodies 76 and between the crankcase 28 and the air intake chamber 74 in a side view. That is, the air cleaner 40 is disposed below the throttle bodies 76 which are inclined rearward and obliquely upward. Thus, it is possible to achieve space saving around the combustion engine E, and the air cleaner 40 is easily disposed above the crankcase 28.

Figure 3:
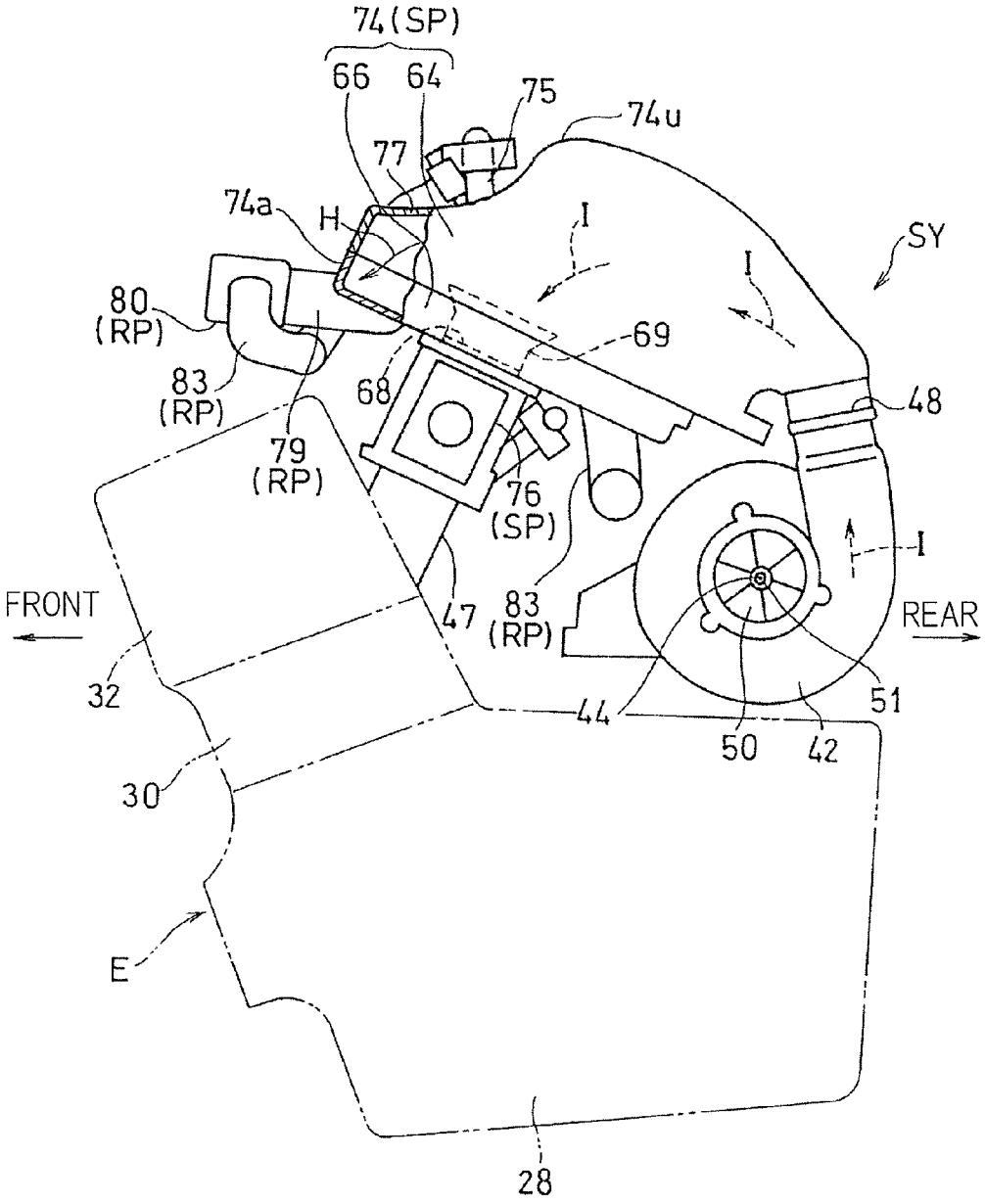
FIG. 3 is a side view showing the supercharging system for the combustion engine.

The fuel tank 15 is disposed above the air intake chamber 74 and the throttle bodies 76. The air intake chamber 74 and the throttle bodies 76 cooperate together to form a supercharged air passage SP which supplies intake air, pressurized by the supercharger 42, to the combustion engine E. As shown in FIG. 3, the air intake chamber 74 includes a chamber main body 64 which forms a principal portion and a holder 66 which has a connection portion to each throttle body 76. The chamber main body 64 and the holder 66 are connected to each other by means of a bolt (not shown). The holder 66 is provided with cylinder side openings (outlets) 68 at which funnels 69 associated with the respective cylinders of the combustion engine E are mounted.

As shown in FIG. 2, relief valves 80 which suppress an increase in the internal pressure in the supercharged air passage SP are provided on a front surface 74*a* of the air intake chamber 74. A relief pipe 83 is connected to the relief valves 80. Connection pipes 79 are provided so as to project frontward from the front surface 74*a* of the air intake chamber 74, and the relief valves 80 are attached to the connection pipes 79. That is, each relief valve 80 is disposed on a relief passage RP and at a position distant from the air intake chamber 74. The connection pipes 79 are formed so as to be integrated with the holder 66. Each connection pipe 79, each relief valve 80, and the relief pipe 83 cooperate together to form the relief passage RP which relieves high-pressure air H within the air intake chamber 74 to the air cleaner 40.

Each relief valve 80 is a differential pressure operating type valve, and opens when a differential pressure between the air intake chamber 74 and a downstream portion of each throttle body 76 is equal to or greater than a predetermined value. Since the differential pressure operating type relief valves 80 are used, it is possible to sufficiently reduce an amount of intake air passing through each throttle when each throttle is rapidly fully opened. However, each relief valve 80 is not limited to the differential pressure operating type valve, and may be, for example, a negative pressure type valve, an electromagnetic type valve, or the like. In addition, the two relief valves 80 are provided so as to be aligned in parallel in the widthwise direction of the motorcycle. Since the two relief valves 80 are provided, each relief valve 80 can be reduced in size. In addition, even if either one of the relief valves 80 breaks down, the high-pressure air H can be relieved by the other relief valve 80, which improves reliability. However, three or more relief valves 80 may be provided, or only one relief valve 80 may be provided.

The relief pipe 83 passes through the right side of the air intake chamber 74 at which the cam chain 58 is disposed, and extends rearward and obliquely downward. Thus, it is possible to prevent interference between the relief pipe 83 and the air intake chamber 74 and to suppress the relief pipe 83 from projecting from the combustion engine E outward in the widthwise direction. The relief pipe 83 which extends rearward and obliquely downward further extends leftward below the air intake chamber 74 and the throttle bodies 76 and between the cylinder block 30 or cylinder head 32 and the supercharger 42, and is finally connected to the air cleaner 40. That is, a downstream end of the relief pipe 83 (the relief passage RP) is connected to the air intake passage IP at the inlet side of the supercharger 42 and at the downstream side of the cleaner element 65. Thus, cleaned air within the air intake chamber 74 is recovered in the air intake passage IP at the suction side of the supercharger 42.

The axis of the air intake passage IP is smoothly curved at the rear side of the cylinder block 30. Specifically, the air intake passage IP is smoothly curved such that the intake air I introduced rearward along a left side surface of the combustion engine E by the air intake duct 70 is introduced into the suction port 46 of the supercharger 42 which is opened leftward.

The downstream end of the relief passage RP is connected to the air intake passage IP at the inlet side of the supercharger 42 from a direction toward a curve center O. Thus, a flow of the intake air I in an outward direction from the curve center is increased by a centrifugal force, whereby the pressure in the relief passage RP is reduced, and the high-pressure air H flowing through the relief passage RP is easily sucked into the supercharger 42 at the time of relief.

The air intake passage IP, the supercharged air passage SP, and the relief passage RP described above cooperate together to form a supercharging system SY of the present invention. As shown in FIG. 3, the relief passage RP is disposed below an upper end 74*u* of the air intake chamber 74. The relief passage RP is connected to the vicinity of the outlets (cylinder side openings) 68 of the air intake chamber 74 with respect to the up-down direction. Thus, even if the pressure around each cylinder decreases, the pressure can rapidly recover.

Figure 4:
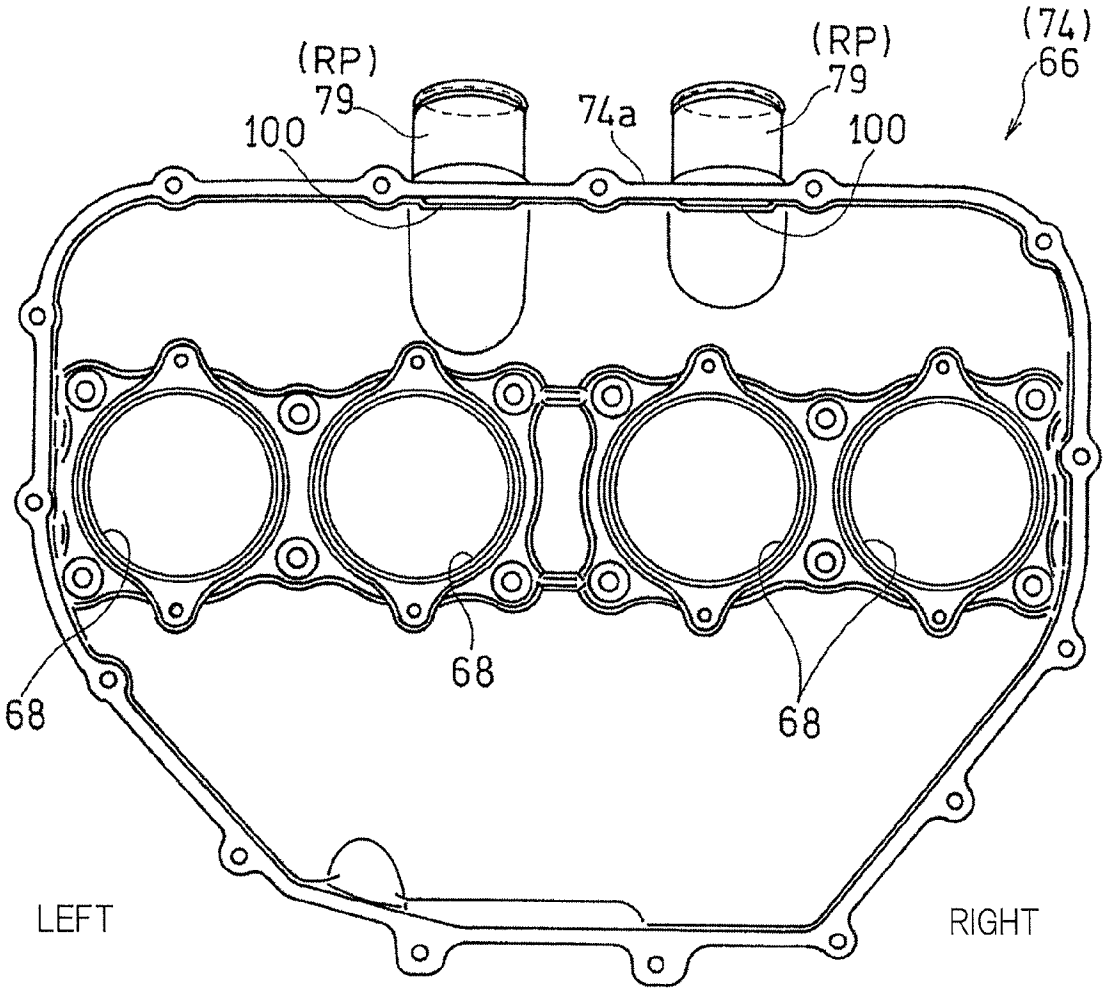
FIG. 4 is a plan view showing a holder of an air intake chamber of the supercharging system.

As shown in FIG. 3, the front surface 74*a* of the air intake chamber 74, to which the relief passage RP is connected, bulges frontward (outward) to form a guide wall 77 which guides the high-pressure air H to the relief passage RP. As shown in FIG. 4, the relief passage RP has inlets 100 at positions adjacent to the cylinder side openings 68 other than the cylinder side openings 68 at both ends. As shown in FIG. 2, since the discharge port 48 of the supercharger 42 is located at the center C2, in the widthwise direction, of the air intake chamber 74, even if the pressure around the inlets 100 (FIG. 4) decreases, the pressure rapidly recovers.

The relief passage RP will be described in detail. In the relief passage RP, the left and right connection pipes 79 project frontward from an intermediate portion, in the widthwise direction of the motorcycle, of the front surface 74*a* of the air intake chamber 74, and the left and right relief valves 80 are connected to leading ends (front ends) of the connection pipes 79, respectively. A first branch pipe 85 extends leftward and obliquely downward from the left relief valve 80. The first branch pipe 85 is folded in a U shape near a left end of the air intake chamber 74 and then extends rightward below the left and right connection pipes 79.

Meanwhile, a second branch pipe 87 extends rightward and obliquely downward from the right relief valve 80. The second branch pipe 87 is curved rearward near a right end of the air intake chamber 74 and then joins the first branch pipe 85 at a collecting portion 89. A joined pipe 90 extends slightly rightward from the collecting portion 89, and then extends rearward and obliquely downward through the right side of the air intake chamber 74. Then, the joined pipe 90 is bent leftward, and further extends leftward so as to be connected to the air cleaner 40 (air intake passage IP). That is, the joined pipe 90 is disposed at the side (at the right side) at which the cam chain 58 and a clutch cover are disposed and which is a side opposite to the cables 82, and extends in a U shape in a plan view. A fuel pipe, an outlet and an inlet for combustion engine cooling water, and the like (not shown) are also disposed at the side (at the left side) opposite to the joined pipe 90. Since the joined pipe 90 is formed in a U shape, the passage is lengthened so that cooling of intake air by heat radiation is enhanced. The first branch pipe 85, the second branch pipe 87, and the joined pipe 90 cooperate together to form the relief pipe 83.

Since the relief passage RP is formed as described above, the relief passage RP can be lengthened. Since the passage is lengthened, it is possible to decrease the temperature of the high-pressure air H passing through the relief passage RP. As shown in FIG. 3, since the cylinder block 30 and the cylinder head 32 are disposed so as to be inclined frontward, it is possible to form a space between the air intake chamber 74, the cylinder head 32, and the throttle body 76, and it is possible to dispose the relief passage RP in this space.

An operation of the supercharging system SY for the combustion engine will be described. When the motorcycle in FIG. 1 runs, the incoming wind A is introduced as the intake air I through the air inlet 24 into the air intake duct 70. The intake air I flows rearward within the air intake duct 70, and is introduced into the air cleaner 40 while changing the direction thereof to an inward direction in the widthwise direction of the motorcycle.

The intake air I introduced into the air cleaner 40 is cleaned by the cleaner element 65 shown in FIG. 2, and then is introduced into the supercharger 42 through the air intake passage IP within the air cleaner 40. The intake air I introduced into the supercharger 42 is pressurized by the impeller 50, and then the intake air I so pressurized is discharged through the discharge port 48. The high-pressure intake air I discharged from the supercharger 42 is introduced into the air intake chamber 74 shown in FIG. 1, and is then supplied to the air intake ports 47 of the combustion engine E through the throttle bodies 76.

When the pressure in the supercharged air passage SP at the downstream side of the supercharger 42 becomes higher than a predetermined value, the relief valves 80 shown in FIG. 2, which are provided at the air intake chamber 74, open to adjust the pressure in the supercharged air passage SP including the air intake chamber 74. The high-pressure air H relieved through the relief valves 80 is introduced into the air cleaner 40 through the relief pipe 83 shown in FIG. 2. That is, the high-pressure air H is returned to the air intake passage IP.

In the above configuration, as shown in FIG. 3, the relief passage RP is disposed below the upper end 74*u* of the air intake chamber 74 and is connected to the front surface 74*a* of the air intake chamber 74. Accordingly, and thus the relief passage RP does not interfere with a component above the combustion engine E.

Each relief valve 80 is disposed on the relief passage RP and at a position away from the air intake chamber 74. Thus, the volume in which pressurized intake air can be stored is increased by the volume of a passage between each relief valve 80 and the air intake chamber 74, in the relief passage RP. In addition, since each relief valve 80 can be disposed away from the air intake chamber 74, the degree of freedom in disposing each relief valve 80 increases.

The supercharger 42 is disposed rearward of the cylinder block 30, and the air intake chamber 74 is disposed above the supercharger 42 and the cylinder block 30. Thus, the relief passage RP connected to the front surface 74*a* of the air intake chamber 74 does not interfere with the supercharger 42 below the relief passage RP, and it is possible to effectively utilize a space around the combustion engine E. In addition, it is possible to dispose the relief pipe 83 in the space formed between the cylinder block 30, the supercharger 42, and the air intake chamber 74, and it is possible to further effectively utilize the space around the combustion engine E.

As shown in FIG. 2, the center C2, in the widthwise direction of the motorcycle, of the air intake chamber 74 is displaced to the left side with respect to the center C1, in the widthwise direction of the motorcycle, of the combustion engine E, and the relief passage RP extends through the right side of the air intake chamber 74. Thus, it is possible to further effectively utilize the space around the combustion engine E.

Since the cables 82 are disposed at the left side of the air intake chamber 74 and the relief passage RP is disposed at the right side of the air intake chamber 74, it is possible to prevent interference between the cables 82 and the relief passage RP, and even further effective utilization of the space around the combustion engine E can be achieved.

The supercharger 42 is disposed rearward of the cylinder block 30, and the air intake duct 70 extends through the lateral side of the combustion engine E so as to be connected to the supercharger 42. Thus, as compared to the case where an air intake duct extends above the combustion engine E, allowance is provided to a space above the combustion engine E. Therefore, the degree of freedom in design increases in a region above the combustion engine E, and it is possible to dispose the relief passage RP in this region.

The downstream end of the relief passage RP is connected to the air intake passage IP at the inlet side of the supercharger 42. The relieved high-pressure air H is smoothly sucked into the air intake passage IP at the inlet side of the supercharger 42 in which the pressure is low. As a result, it is possible to prevent the high-pressure air H from flowing out of the air intake passage IP.

As shown in FIG. 3, the relief passage RP is connected to the vicinity of the outlets (cylinder side openings) 68 of the air intake chamber 74. In the case where the relief passage RP is connected to the vicinity of the outlets 68 of the air intake chamber 74, there is the possibility that the pressure around the outlets 68 of the air intake chamber 74 decreases. However, in this configuration, since each relief valve 80 is disposed at a position away from the air intake chamber 74, a large amount of pressurized intake air is present between each relief valve 80 and the air intake chamber 74. Therefore, even when the relief passage RP is connected to the vicinity of the outlets 68 of the air intake chamber 74, it is possible to prevent the pressure around the outlets 68 of the air intake chamber 74 from decreasing.

The present invention is not limited to the preferred embodiment described above, and various additions, modifications, or deletions may be made without departing from the gist of the invention. For example, in the preferred embodiment described above, the relief passage RP is connected to the front surface 74*a* of the air intake chamber 74, but only needs to be connected to an outer surface of the air intake chamber other than an upper surface thereof. In the case where the relief passage RP is connected to a lower surface or a rear surface of the air intake chamber 74, it is possible to reduce the dimension of the motorcycle in the widthwise direction of the motorcycle.

In addition, in the preferred embodiment described above, the incoming wind A is used as the intake air I, but a structure may be provided in which incoming wind is not used as intake air. Furthermore, the supercharger 42 may be of a type driven by means other than driving power of a combustion engine. If a space can be secured, the relief pipe 83 may be disposed at the left side of the air intake chamber 74. The saddle-riding type vehicle of the present invention may be a vehicle other than a motorcycle, specifically, a four-wheel buggy, a three-wheel vehicle, or the like. If each relief valve 80 is disposed within the air intake chamber 74, it is possible to avoid interference between each relief valve 80 and a component disposed outside the air intake chamber 74. Therefore, this is construed as included within the scope of the present invention.

REFERENCE NUMERALS

30 . . . cylinder block
42 . . . supercharger
70 . . . air intake duct
74 . . . air intake chamber
74*a* . . . front surface of air intake chamber
80 . . . relief valve
82 . . . cables
E . . . combustion engine
IP . . . air intake passage
RP . . . relief passage
SY . . . supercharging system

What is claimed is:

1. A supercharging system for a combustion engine, comprising:

a supercharger configured to pressurize intake air and supply the intake air to the combustion engine of a saddle-riding type vehicle;

an air intake chamber connected to downstream of the supercharger;

a relief passage configured to relieve high-pressure gas within the air intake chamber; and a relief valve provided on the relief passage, wherein the air intake chamber is disposed above the combustion engine, and an entirety of the relief passage is disposed below an upper end of the air intake chamber and the relief passage is connected to a front outer surface of the air intake chamber, with respect to a travelling direction of the vehicle, and the relief passage is provided so that an upstream portion of the relief passage projects frontward from the front surface of the air intake chamber.

2. The supercharging system for the combustion engine as claimed in claim 1, wherein the relief valve is disposed on the relief passage and at a position distant from the air intake chamber.

3. The supercharging system for the combustion engine as claimed in claim 2, wherein the relief passage is connected to a vicinity of an outlet of the air intake chamber.

4. The supercharging system for the combustion engine as claimed in claim 1, wherein the supercharger is disposed rearward of a cylinder block of the combustion engine, with respect to the travelling direction of the vehicle, the air intake chamber is located above the supercharger.

5. The supercharging system for the combustion engine as claimed in claim 4, wherein a chamber center, in a widthwise direction of the vehicle, of the air intake chamber is displaced to one side in the widthwise direction of the vehicle with respect to an engine center of the combustion engine, and an air cleaner is disposed on the one side of the supercharger in the widthwise direction of the vehicle; and the relief passage extends through a lateral side of the air intake chamber, which is the other side in the widthwise direction of the vehicle, and is connected to the air cleaner.

6. The supercharging system for the combustion engine as claimed in claim 4, wherein a throttle body is disposed between the air intake chamber and a cylinder head of the combustion engine, and the relief passage is disposed in a space formed between the air intake chamber, the cylinder head and the throttle body.

7. The supercharging system for the combustion engine as claimed in claim 6, wherein an air cleaner is disposed below the throttle body.

8. The supercharging system for the combustion engine as claimed in claim 4, wherein the supercharger includes a discharge port opened upward, and the discharge port of the supercharger is directly connected with the air intake chamber.

9. The supercharging system for the combustion engine as claimed in claim 8, wherein the discharge port of the supercharger is disposed at a center position of the air intake chamber in the widthwise direction of the vehicle, and the relief passage is connected with the front surface of the air intake chamber in the widthwise direction of the vehicle.

10. The supercharging system for the combustion engine as claimed in claim 1, wherein cables of the vehicle are disposed at one lateral side of the air intake chamber, and the relief passage is disposed at the other lateral side of the air intake chamber.

11. The supercharging system for the combustion engine as claimed in claim 10, wherein the supercharger is disposed rearward of a cylinder block of the combustion engine, with respect to the travelling direction of the vehicle, and an air intake duct configured to supply air in front of the combustion engine, with respect to the travelling direction of the vehicle, to the supercharger extends through the one lateral side of a cylinder block of the combustion engine and below an upper end of a cylinder head of the combustion engine.

12. The supercharging system for the combustion engine as claimed in claim 1, wherein a downstream end of the relief passage is connected to an air intake passage at an inlet side of the supercharger.

13. The supercharging system for the combustion engine as claimed in claim 1, wherein an air intake passage which introduces outside air into the supercharger is disposed below the air intake chamber.

14. The supercharging system for the combustion engine as claimed in claim 1, wherein the air intake chamber is located above the supercharger, and the supercharger includes: an impeller which pressurizes intake air; and a discharge port opened upward.

15. The supercharging system for the combustion engine as claimed in claim 1, wherein a connection pipe is provided at the air intake chamber, and a relief pipe is provided to be connected to the connection pipe, the connection pipe and the relief pipe forming the relief passage; and the relief pipe extends below the upper end of the air intake chamber.

16. The supercharging system for the combustion engine as claimed in claim 15, wherein the relief pipe passes through a lateral side of the air intake chamber, at which a cam chain is disposed.

17. The supercharging system for the combustion engine as claimed in claim 15, wherein cables of the vehicle are disposed at one side of the air intake chamber in the vehicle widthwise direction, and the relief passage is disposed at the other side of the air intake chamber in the vehicle widthwise direction.

18. A supercharging system for a combustion engine, comprising:

a supercharger configured to pressurize intake air and supply the intake air to the combustion engine of a saddle-riding type vehicle;

an air intake chamber connected to downstream of the supercharger;

a relief passage configured to relieve high-pressure gas within the air intake chamber; and a relief valve provided on the relief passage, wherein;

the air intake chamber is disposed above the combustion engine;

the relief passage is disposed below an upper end of the air intake chamber and connected to a front surface of the air intake chamber with respect to a travelling direction of the vehicle;

the relief passage is provided so that an upstream portion of the relief passage projects frontward from the front surface of the air intake chamber;

a connection pipe is provided at the air intake chamber, and a relief pipe is provided to be connected to the connection pipe, the connection pipe and the relief pipe forming the relief passage; and the relief pipe extends below the upper end of the air intake chamber.

* * * * *